US005475576A

United States Patent [19]

Daniels

[11] Patent Number: 5,475,576

[45] Date of Patent: Dec. 12, 1995

[54] COMPACT FLUORESCENT SIGN LIGHT UNIT

[76] Inventor: Eldridge R. Daniels, 2507 SE. 15th St., Pompano Beach, Fla. 33062

[21] Appl. No.: 136,292

[22] Filed: Oct. 14, 1993

[51] Int. Cl.[6] ..... F21V 23/02

[52] U.S. Cl. ..... 362/222; 362/216; 362/260; 362/382; 362/812; 40/541

[58] Field of Search ..... 362/216, 221, 362/222, 260, 382, 812; 40/541, 545, 550, 559, 563, 572

[56] References Cited

U.S. PATENT DOCUMENTS

| | | | |
|---|---|---|---|
| 2,185,708 | 1/1940 | Meyerricks | 40/545 |
| 2,459,422 | 1/1949 | Fuller | 40/545 |
| 2,564,110 | 8/1951 | Howenstine et al. | 362/812 |
| 3,965,597 | 6/1976 | Noellert | 40/545 |
| 3,974,584 | 8/1976 | Shorette | 40/545 |
| 4,692,848 | 9/1987 | Poyer | 362/216 |
| 5,189,339 | 2/1993 | Peshak | 362/216 |

FOREIGN PATENT DOCUMENTS

| | | | |
|---|---|---|---|
| 131886 | 5/1985 | European Pat. Off. | 362/260 |
| 1069683 | 5/1967 | United Kingdom | 362/221 |

*Primary Examiner*—Ira S. Lazarus
*Assistant Examiner*—Alan B. Cariaso
*Attorney, Agent, or Firm*—Herbert L. Lerner; Laurence A. Greenberg; Werner H. Stemer

[57] ABSTRACT

A compact fluorescent sign light unit includes a ballast, a flat backplate and a socket for receiving a fluorescent tube, such as a twin tube lamp. The ballast has a substantially flat backwall, attachment devices for rigidly attaching the ballast to a support, and electrical connectors for connecting to an electric current source. The backplate has a forward surface rigidly attached to the backwall of the ballast. The socket is attached to the forward surface such that the fluorescent light tube extends substantially perpendicularly away from the forward surface, above a part of the ballast which is not covered with the socket.

6 Claims, 1 Drawing Sheet

COMPACT FLUORESCENT SIGN LIGHT UNIT

BACKGROUND OF THE INVENTION

1. Field of the Invention

The invention relates to fluorescent lighting devices and, more particularly, to fluorescent lighting units used in illuminated signs, logos or channel letters.

2. Description of the Related Art

Many lighting units are known in the art for replacing expensive neon light sources with fluorescent light sources. One of the advantages of fluorescent light sources is the fact that they provide a much higher light output and lighting intensity than comparable neon sources. Due to the higher intensity, however, the fluorescent tubes must be placed farther from the illuminated face since, otherwise, the tube becomes visible. This creates a light pattern on the face while it is desirable to have the face evenly lighted. In the art, this effect is known as a shadow.

Another problem associated with prior art tube lights is found in the problematic adaptation to a given sign shape. Forming of neon or fluorescent tubes is a relatively time consuming effort and, additionally, it is rather expensive. In the case of breakage, they are not easily replaced.

SUMMARY OF THE INVENTION

It is accordingly an object of the invention to provide a compact fluorescent sign light unit, which overcomes the hereinafore-mentioned disadvantages of the heretofore-known devices of this general type and which allows easy installation, superior light output without shadow casting and easy replaceability in the case of failure.

With the foregoing and other objects in view there is provided, in accordance with the invention, a compact fluorescent sign light unit, comprising:

a ballast having a substantially flat backwall, attachment means for rigidly attaching the ballast to a support, and means for connecting to an electric current source;

a substantially flat backplate having a forward surface rigidly attached to the backwall of the ballast; and socket means for receiving a fluorescent light tube, the socket means being attached to the forward surface such that the fluorescent light tube extends substantially perpendicularly away from the forward surface.

In accordance with an added feature of the invention, the socket means is a socket for receiving a fluorescent twin tube lamp. The standard socket is preferably formed of plastic such as polycarbonet. The twin tube is a standard fluorescent twin tube of either 5W, 7W, 9W or 13W power.

In accordance with an additional feature of the invention, the compact fluorescent sign light unit includes rivets rigidly connecting the socket means and/or the ballast to the backplate. While rivets are the preferred attachment means, it is also possible to clamp, screw, glue or otherwise connect the socket and the ballast to the backplate.

In accordance with a concomitant feature of the invention, the ballast has a length, a width and a height, the backwall defining the width and the height; wherein the socket has a height substantially corresponding to a thickness of the fluorescent light tube, and the backplate has a width substantially equal to the width of the ballast and a height substantially corresponding to a sum of the height of the ballast and the height of the socket. The ballast has a substantially rectangular footprint and the backplate attaches to a narrow side face of the ballast. This assures the most compact configuration, with the twin tube extending flatly above the ballast and the socket covering only a smaller part of the footprint of the ballast.

Other features which are considered as characteristic for the invention are set forth in the appended claims.

Although the invention is illustrated and described herein as embodied in a compact fluorescent sign light unit, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
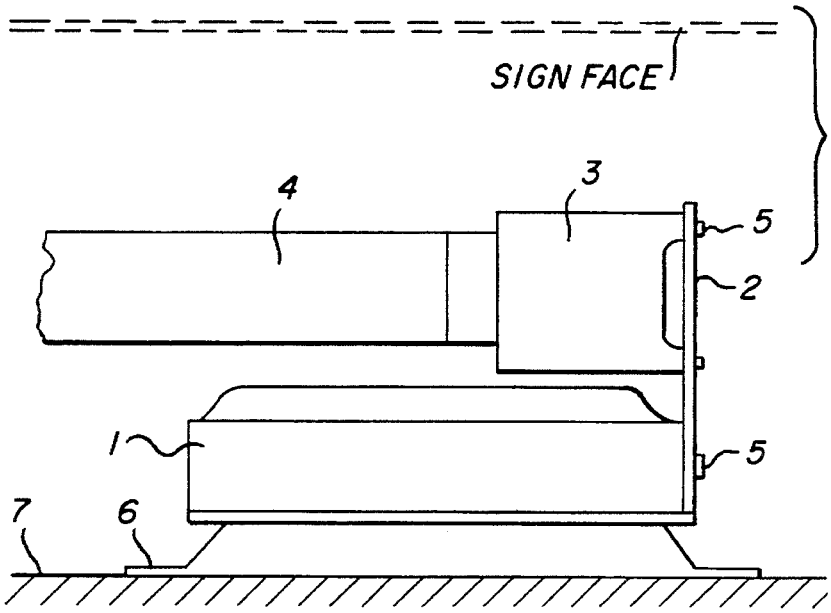
FIG. 1 is a side-elevational view of the compact fluorescent unit according to the invention.
Figure 2:
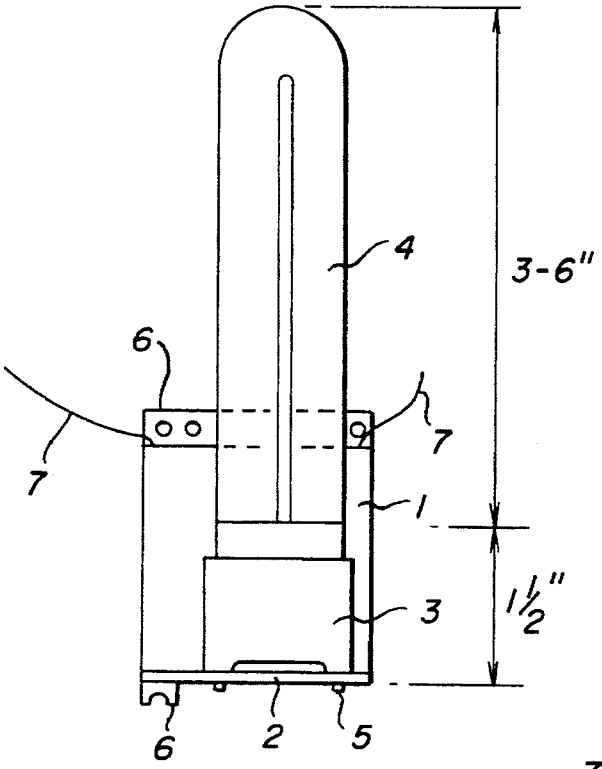
FIG. 2 is a top-plan view of the sign light unit, showing approximate measurements.
Figure 3:
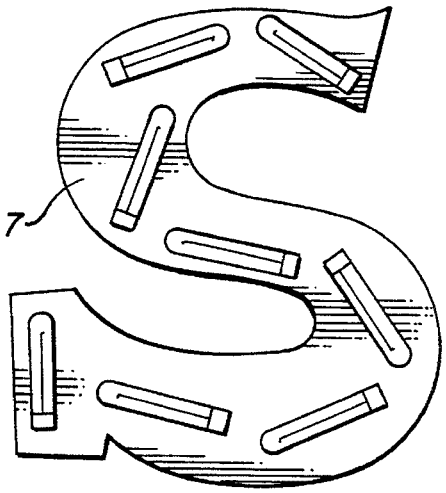
FIG. 3 is a side-elevational view of an approximate unit distribution within a sign letter.

Referring now to the figures of the drawing in detail and first, particularly, to FIG. 1 thereof, there is seen a ballast 1, a backplate 2, a socket 3 and a fluorescent tube 4. The unit consists essentially of the members 1-3, whereby the backplate 2 is permanently and rigidly attached to the ballast 1 and the socket 3 is permanently and rigidly attached to the backplate 2.

The backplate 2 has a forward surface at which the ballast 1 and the socket 3 are attached. The height of the backplate 2 is slightly greater than a combined height of the ballast 1 and the socket 3. Both the ballast 1 and the socket 3 extend perpendicularly away from the forward surface of the backplate 2, such that a minimum footprint expanse is attained. The minimum footprint is necessary in the context of this invention so as not to cause shadow casting and to allow densest possible packing of the units relative to one another.

The ballast 1, the socket 3, and the fluorescent tube 4 are commercially available. By way of example, the socket 3 may be purchased from Edwin Gaynor Co. of Stradford, Connecticut, or from Triboro Socket Co. of Doyle, Pennsylvania; the ballast 1, which must be a type I, outdoor ballast, may be purchased from the Robertson Transformer Co. of Blue Island, Illinois, or from Keystone Transformer Co. of Pennsylvania; the fluorescent bulb 4 is available from Osram Sylvania or from Philips Lighting Co.

The fluorescent bulb 4 is preferably a standard white twin tube lamp which comes in different standard sizes, for instance in 5W, 7W, 9W and 13W.

In the preferred embodiment, the backplate 2 is rivetted to the ballast 1 and to the socket 3. The backplate 2 is preferably formed of aluminum. Rivets 5 are preferably #44 metal rivets. The ballast 1 has a steel casing with a number of attachment extensions 6 with which the sign light unit is attached to a support 7 of a sign light. The socket 3 is formed of polycarbonet material.

The unit comes in different sizes, in accordance with the rated lighting power. The 13 watt unit is 7.5" long, 2.25" tall and 2.0" wide. The lower wattage units are about 2.25" wide and 2" tall. Depending on the length of the fluorescent bulb, the lengths of the units are 4.5" (5W), 5.5" (7W) and 6.75" (9W), respectively. Electric current consumption averages about 0.028 amperes at 120 V at 60 Hz. Cables 7 are provided for wiring the ballast to an electric current source.

One of the advantages of the fluorescent sign light units is their dependability in terms of temperature and starting times. It has been found that starting temperatures for the 13W, 7W and 5W units may be as low as 0° F. The minimum starting temperature for the 9W unit has been found to be about 20° F.

Due to the compactness of the unit, many distribution schemes within the light channel or light cavity are possible. For best results, between three and four units are provided per upright foot of block, spurred or script channel letters with thick and thin strokes from 3" to 10". For box signs, it has been found that one unit per square foot of sign single or double face provides the best results.

In the case of plastic or LEXAN (TM) face signs, the fluorescent bulb should be placed about 3" from the face. Accordingly, the minimum depth of the sign is only 5.5". It is further noted that, in light of the application of the compact unit to signs, all of the parts must be of a light color (preferably white).

I claim:

1. A compact fluorescent sign light unit for lighting a sign with an illuminated face, comprising:

a ballast having a substantially flat backwall, attachment means for rigidly attaching said ballast to a support, and means for connecting to an electric current source;

a substantially flat backplate having a forward surface rigidly attached to said backwall of said ballast; and socket means for receiving a fluorescent light tube, said socket means being attached to said forward surface immediately adjacent said ballast such that the fluorescent light tube extends substantially perpendicularly away from said forward surface and substantially parallel to the support on which said ballast is attachable and substantially parallel to the illuminated face of the sign.

2. The compact fluorescent sign light unit according to claim 1, wherein said socket means is a socket for receiving a fluorescent twin tube lamp.

3. The compact fluorescent sign light unit according to claim 1, including rivets rigidly connecting said socket means to said backplate.

4. The compact fluorescent sign light unit according to claim 1, including rivets rigidly connecting said ballast to said backplate.

5. The compact fluorescent sign light unit according to claim 1, wherein said ballast has a length, a width and a height smaller than the length and the width, said backwall defining said width and said height; wherein said socket has a height substantially corresponding to a thickness of the fluorescent light tube, and said backplate has a width substantially equal to said width of said ballast and a height substantially corresponding to a sum of said height of said ballast and said height of said socket.

6. In combination with a sign having an illuminated face substantially extending in a plane and a support for attaching a sign light unit thereto at a given spacing from the illuminated face, a compact fluorescent sign light unit to be disposed in the sign for illuminating the sign, said sign light unit comprising:

a ballast having a substantially flat backwall, attachment means for rigidly attaching said ballast to the support for attaching the sign light unit, and means for connecting to an electric current source;

a substantially flat backplate having a forward surface rigidly attached to said backwall of said ballast; and a fluorescent light tube and socket means for receiving said fluorescent light tube, said socket means being attached to said forward surface such that said fluorescent light tube extends substantially perpendicularly away from said forward surface and substantially parallel with said illuminated face of said sign.

* * * * *